US007727016B2

(12) United States Patent
Lamdiziz et al.

(10) Patent No.: US 7,727,016 B2
(45) Date of Patent: Jun. 1, 2010

(54) PLUG HAVING A MATTING SEAL

(75) Inventors: Mohamed Lamdiziz, Marbach (DE); Chris Schimmel, Weinstadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/787,256

(22) Filed: Apr. 12, 2007

(65) Prior Publication Data

US 2007/0249214 A1 Oct. 25, 2007

(51) Int. Cl.
*H01R 13/40* (2006.01)

(52) U.S. Cl. ..... 439/587; 439/275; 439/271

(58) Field of Classification Search ..... 439/587, 439/589, 274, 275, 271
See application file for complete search history.

(56) References Cited

U.S. PATENT DOCUMENTS 3,701,965 A * 10/1972 DuRocher et al. ..... 439/86
4,684,190 A * 8/1987 Clark et al. ..... 439/587
5,632,653 A * 5/1997 Sawada ..... 439/587
5,634,807 A * 6/1997 Saito ..... 439/275
6,196,872 B1 * 3/2001 Murakami et al. ..... 439/587
6,305,990 B1 * 10/2001 Ward ..... 439/752
6,527,586 B2 * 3/2003 Okamura et al. ..... 439/587
6,599,153 B2 * 7/2003 Nishide ..... 439/681
6,773,278 B2 * 8/2004 Valasek et al. ..... 439/157

* cited by examiner

*Primary Examiner*—Tho D Ta
*Assistant Examiner*—Travis Chambers
(74) *Attorney, Agent, or Firm*—Kenyon & Kenyon LLP

(57) ABSTRACT

In a plug for an electrical plug connection, having a contact carrier joined together of an upper part and a lower part, the upper part and the lower part having plug chambers that are aligned with one another, and the plug chambers of the lower part having electrical contacts for contacting by electrical contacts of a mating connector that reach through the plug chambers of the upper part, having a matting seal for sealing the plug chambers and having a pressure plate pressing on the matting seal, it is provided that the matting seal is situated between the upper and lower parts of the contact carrier, and the pressure plate is integrated into the upper part.

3 Claims, 2 Drawing Sheets

PLUG HAVING A MATTING SEAL

FIELD OF THE INVENTION

The present invention relates to a plug for an electrical plug connection.

BACKGROUND INFORMATION

In known plugs of this kind, a sealing mat, or rather matting seal (e.g. a rubber mat or a gel mat) is provided for the protection of the contacting locations of the plug. For this purpose, the contact pins, that preferably have a round cross section, of a mating connector are sealed by the sealing matting applied in the plug in response to the introduction of the mating connector. It is prevented thereby that, for example, water is able to reach the contacting locations from the mating connector via its contact pins, and trigger corrosion there. In order to obtain this sealing mat as a sound sealing element within the meaning of a complete sealing, in spite of contact pins having pierced through it, elastic material (such as rubber) or material that continues to flow (such as gel) is used for the sealing mat, and the sealing or the material that continues to flow is supported using a pressure plate. The sealing matting is clamped in place between the contact carrier's upper part of the plug and the pressure plate which is latched to the upper part of the contact carrier. The electrical contacts of the plug are provided on the contact carrier's lower part, which is connected to the upper part of the contact carrier. Therefore, the plug always has to be equipped with the pressure plate, in order for the sealing mat to be held to the upper part of the contact carrier, that is, in order to be present in the condition in which it can perform its function. From this, there follows an additional material and assembling expenditure in the production of such a plug. Additional tools and assembly steps are also required for the production of the pressure plate, which, together with the assembly, represents a considerable additional expenditure.

SUMMARY OF THE INVENTION

The plug according to the present invention has the advantage that the function of the present pressure plate is integrated into the upper part of the contact carrier, and thus one may do without an additional pressure plate. Production costs and assembly costs as well as the number of individual parts of the plug connection can be reduced thereby.

DETAILED DESCRIPTION

Figure 1:
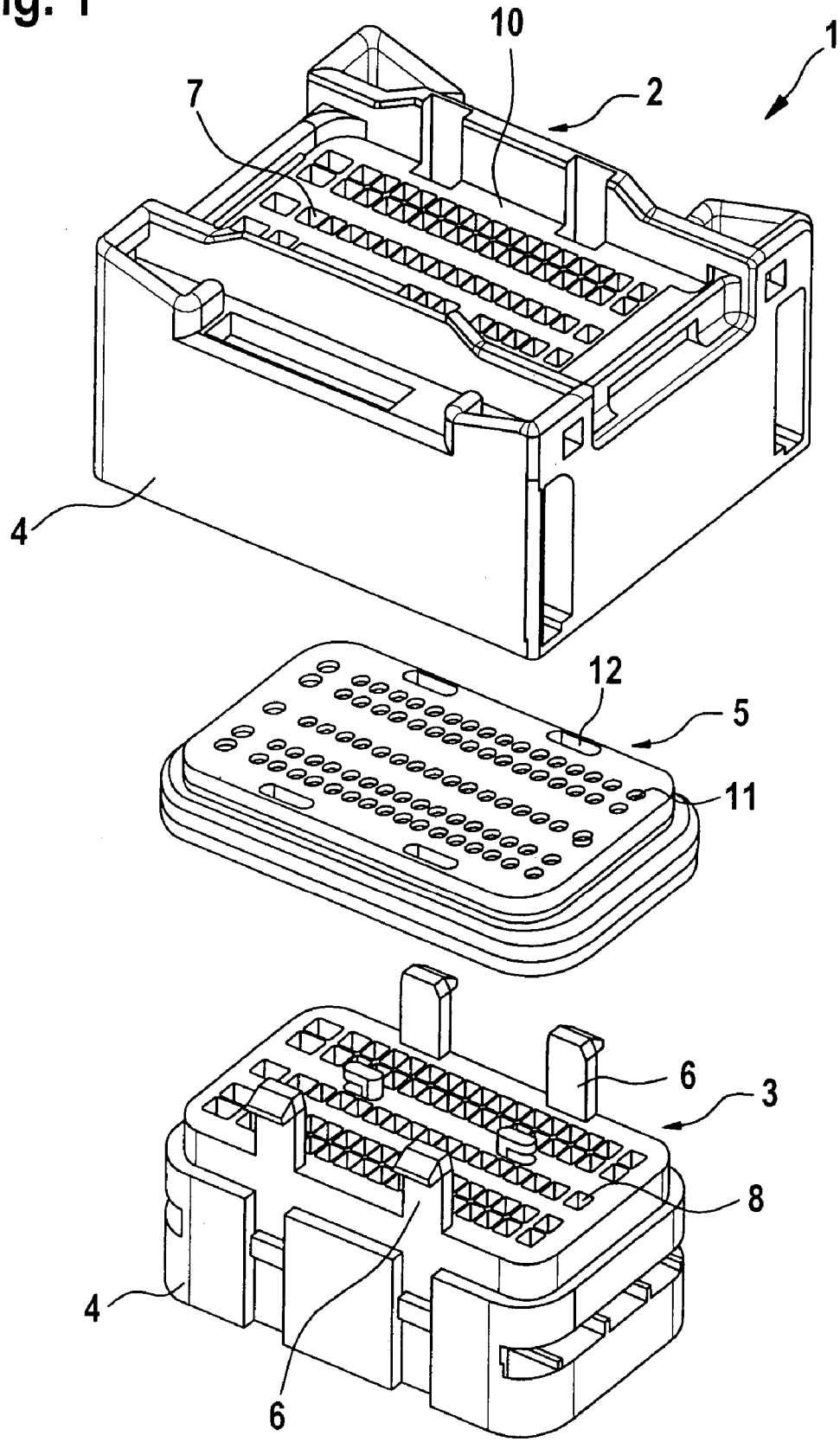
FIG. 1 shows an exploded illustration of the plug according to the present invention.

FIG. 1 shows a plug 1 for an electrical plug connection of an electronic control unit in exploded form. Plug 1 has a contact carrier 4 made up of an upper part 2 and a lower part 3 plugged together, as well as a matting seal 5, which is compressed between upper and lower parts 2, 3. Lower part 3 is plugged into upper part 2, and is latched to upper part 2 with the aid of lateral latching arms 6. Upper part 2 and lower part 3 have plugging chambers 7, 8 that are aligned with one another, electrical contacts 9 (FIG. 2) being provided in plug chambers 8 of lower part 3. Upper part 2 has an upper-side plug accommodation 10 for a mating connector (that is not shown), whose contact pins reach through plug chambers 7 of upper part 2 and corresponding openings 11 in matting seal 5, and contact electrical contacts 9 in lower part 3. Matting seal 5 (e.g. a rubber mat or a gel mat) is used for sealing chambers 8 of lower part 3 and the contact pins of the mating connector that are plugged into these.

Figure 2:
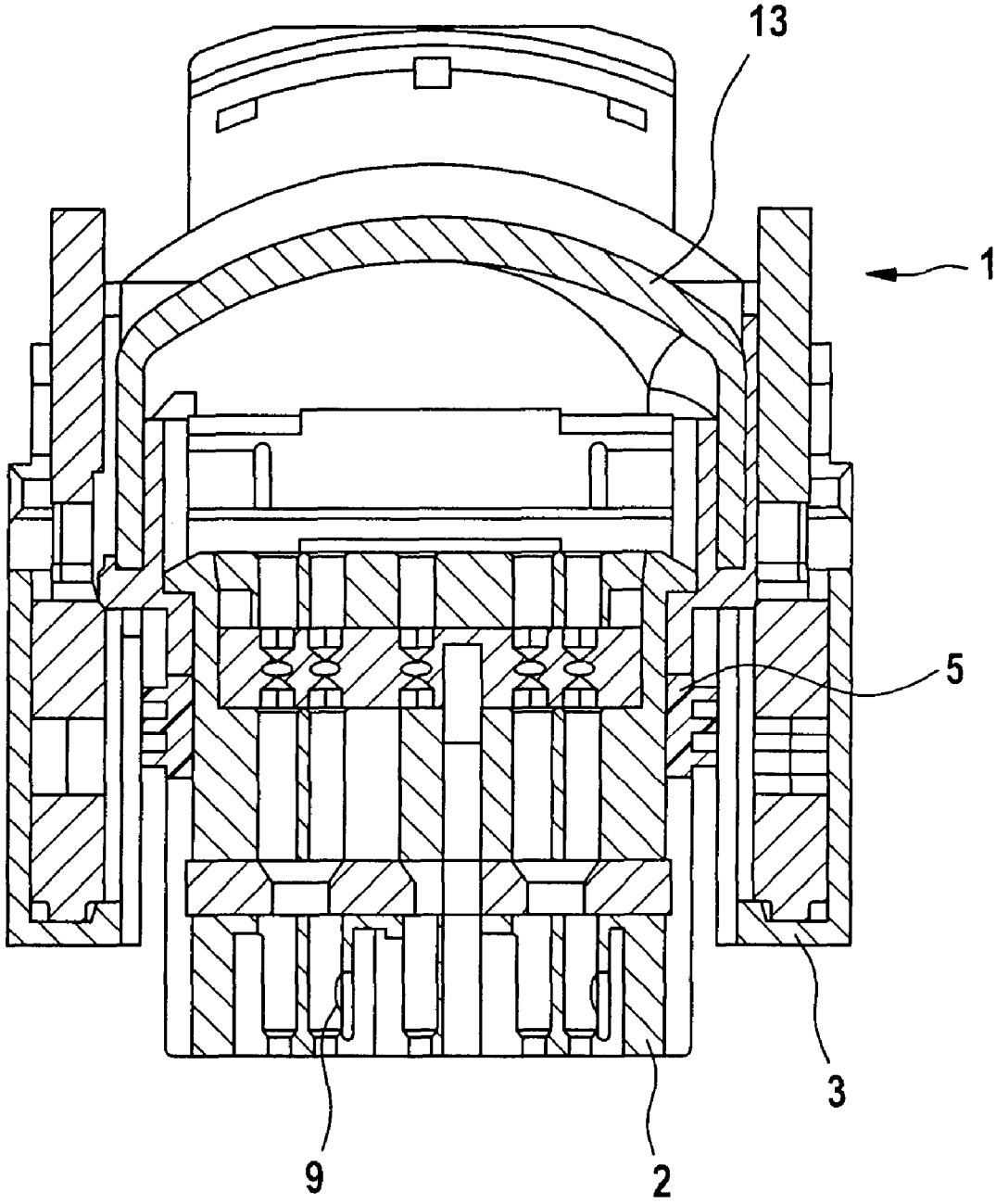
FIG. 2 shows a longitudinal section of the plug according to the present invention.

During assembly of plug 1, first of all matting seal 5 is mounted onto lower part 3, in that latching arms 6 reach through corresponding openings 12 of matting seal 5. Lower part 3 is then plugged into a lower-side plug accommodation of upper part 2, until latching arms 6 latch onto upper part 2. In the latched state, matting seal 5 is thus compressed between upper and lower parts 2, 3 of contact carrier 4. Upper part 2, or rather its under side, thus additionally takes over the function of a pressure plate. FIG. 2 shows ready mounted plug 1, having a cover 13 set upon upper part 2.

What is claimed is:

1. A plug for an electrical plug connection, comprising:

a contact carrier including an upper part and a lower part joined together, the upper part and the lower part having plug chambers that are aligned with one another, the plug chambers of the lower part having electrical contacts for contacting by electrical contacts of a mating connector that reach completely through the plug chambers of the upper part and reach into the plug chambers of the lower part;

a matting seal situated between the upper and lower parts of the contact carrier for sealing the plug chambers;

a pressure plate pressing on the matting seal, the pressure plate being integrated into the upper part; and a cover situated on the upper part;

wherein the upper part covers a substantial portion of the lower part situated below the matting seal;

wherein the upper part and the lower part are latched with each other;

wherein one of the upper part and the lower part has latching arms which reach through corresponding openings in the matting seal; and wherein a width of at least a portion of the latching arms is substantially greater than a corresponding width of the openings in the matting seal, and in an assembled state of the plug, the matting seal is form-locked to the latching arms.

2. The plug according to claim 1, wherein the pressure plate is formed by an under side of the upper part.

3. The plug according to claim 1, wherein the upper part and the lower part are plugged into each other.

* * * * *